US008915381B2

(12) United States Patent
Brozak et al.

(10) Patent No.: US 8,915,381 B2
(45) Date of Patent: Dec. 23, 2014

(54) VERTICAL ROLL WRAP PRODUCT TRAY KIT

(75) Inventors: Emory Brozak, Strongsville, OH (US); Anthony Santarelli, North Olmsted, OH (US)

(73) Assignee: American Greetings Corporation, Cleveland, OH (US)

( * ) Notice: Subject to any disclaimer, the term of this patent is extended or adjusted under 35 U.S.C. 154(b) by 150 days.

(21) Appl. No.: 13/483,093

(22) Filed: May 30, 2012

(65) Prior Publication Data

US 2012/0305508 A1 Dec. 6, 2012

Related U.S. Application Data

(60) Provisional application No. 61/492,091, filed on Jun. 1, 2011.

(51) Int. Cl.

| | |
|---|---|
| ***A47F 1/04*** | (2006.01) |
| *A47F 5/00* | (2006.01) |
| *B65D 81/24* | (2006.01) |
| *A47B 57/00* | (2006.01) |

(52) U.S. Cl.
USPC ..... 211/60.1; 211/184; 206/390; 108/61

(58) Field of Classification Search
CPC ..... A47B 57/58; A47B 57/581; A47F 7/00; A47F 5/005; A47F 5/0062
USPC ..... 211/85.5, 13.1, 45, 50, 59.4, 60.1, 62, 211/85.18, 85.28, 126.2, 126.1, 126.6, 211/126.13, 133.1, 189, 195, 184; 108/60, 108/61; 206/390, 443; 312/35
See application file for complete search history.

(56) References Cited

U.S. PATENT DOCUMENTS

| | | | | | |
|---|---|---|---|---|---|
| 289,825 | A | * | 12/1883 | Fulton | 211/50 |
| 408,464 | A | * | 8/1889 | Crupt | 119/513 |
| 1,227,703 | A | * | 5/1917 | Ulrich | 108/61 |
| 1,409,029 | A | * | 3/1922 | Riordan | 273/142 R |
| 1,636,608 | A | * | 7/1927 | Kenyon, Jr. et al. | 211/60.1 |
| 1,820,275 | A | * | 8/1931 | Kelley | 211/54.1 |
| 2,038,781 | A | * | 4/1936 | Drew | 211/13.1 |
| 2,062,802 | A | * | 12/1936 | Walker | 211/44 |
| 2,108,950 | A | * | 2/1938 | Stober | 312/140 |
| 2,529,826 | A | * | 11/1950 | Walker | 312/140 |
| 2,646,174 | A | * | 7/1953 | Hutten et al. | 211/44 |
| 2,855,258 | A | * | 10/1958 | Moncier | 312/140.3 |
| 2,915,193 | A | * | 12/1959 | Bromberg | 108/61 |
| 2,933,195 | A | * | 4/1960 | Radek | 211/153 |
| 2,934,214 | A | * | 4/1960 | Mogulescu et al. | 211/126.12 |
| 2,934,215 | A | * | 4/1960 | Mogulescu et al. | 211/133.1 |

(Continued)

*Primary Examiner* — Joshua J Michener
*Assistant Examiner* — Devin Barnett
(74) *Attorney, Agent, or Firm* — Christine Flanagan

(57) ABSTRACT

A vertical roll wrap tray kit of the present invention includes at least one product tray, a plurality of spacer clips, a plurality of wire dividers and a plurality of push clips. The product tray can be attached to various types of retail display units. The product tray contains two slot walls which are sized to accommodate insertion of the wire dividers. The dividers are used to divide the tray into segments or compartments in which the roll wrap material is stored and displayed in a vertical arrangement. The width of the rows or compartments can be varied based on the diameter of the roll wrap product. Spacer clips are used to hold two adjacent dividers into place. The tray is angled slightly in a backwards direction to avoid accidental removal of the vertical roll wrap.

19 Claims, 3 Drawing Sheets

(56) References Cited

U.S. PATENT DOCUMENTS 2,945,732 A * 7/1960 Edmondson, Jr. ..... 312/140.3
2,956,685 A * 10/1960 Levi ..... 211/40
3,004,814 A * 10/1961 Schulze ..... 312/140.1
3,160,282 A * 12/1964 Gunn ..... 211/184
3,269,547 A * 8/1966 Chamberlin ..... 211/11
3,385,451 A * 5/1968 Anderson ..... 211/60.1
3,812,974 A * 5/1974 Sylvester ..... 211/23
3,856,137 A * 12/1974 Brindley ..... 206/564
4,047,614 A * 9/1977 Radek ..... 211/20
4,155,446 A * 5/1979 Aronson ..... 206/214
4,190,166 A * 2/1980 Allsop ..... 211/60.1
4,193,650 A * 3/1980 Gray et al. ..... 312/205
4,293,062 A * 10/1981 Bustos ..... 193/2 D
4,410,093 A * 10/1983 Chiariello et al. ..... 211/11
4,476,985 A * 10/1984 Norberg et al. ..... 211/133.6
4,697,710 A * 10/1987 Gradecki et al. ..... 211/45
4,889,397 A * 12/1989 Ryan ..... 312/332.1
4,892,198 A * 1/1990 Johnson ..... 211/40
4,955,486 A * 9/1990 Trulaske, Sr. ..... 211/59.2
5,000,344 A * 3/1991 Janssen ..... 221/92
5,205,421 A * 4/1993 Bustos ..... 211/59.2
5,207,334 A * 5/1993 Lear ..... 211/41.11
5,255,802 A * 10/1993 Krinke et al. ..... 211/184
5,269,447 A * 12/1993 Gower et al. ..... 224/542
5,380,079 A * 1/1995 Hamilton ..... 312/9.55
5,396,989 A * 3/1995 Hein ..... 206/366
5,474,190 A * 12/1995 Won-Kim ..... 211/41.12
5,520,316 A * 5/1996 Chen ..... 224/539
5,553,708 A * 9/1996 Lawrence et al. ..... 206/419
5,617,960 A * 4/1997 Bishop ..... 211/60.1
5,779,035 A * 7/1998 Marrelli et al. ..... 206/233
5,971,273 A * 10/1999 Vallaire ..... 235/381
6,041,720 A * 3/2000 Hardy ..... 108/60
6,082,557 A * 7/2000 Leahy ..... 211/59.3
6,116,436 A * 9/2000 Ferrucci et al. ..... 211/187
6,152,305 A * 11/2000 Green ..... 206/764
6,164,462 A * 12/2000 Mumford ..... 211/59.2
6,273,276 B1 * 8/2001 Upton et al. ..... 211/59.2
6,364,130 B2 * 4/2002 Wright ..... 211/41.3
6,389,991 B1 * 5/2002 Morrisson ..... 108/61
6,396,990 B1 * 5/2002 Ehn et al. ..... 385/135
6,460,710 B1 * 10/2002 Dardashti ..... 211/184
6,520,356 B2 * 2/2003 Miller, Jr. ..... 211/188
6,935,514 B2 * 8/2005 Lackey et al. ..... 211/60.1
7,048,122 B2 * 5/2006 Dodson et al. ..... 206/443
7,150,361 B2 * 12/2006 Calleja ..... 211/49.1
7,182,209 B2 * 2/2007 Squitieri ..... 211/59.2
D538,106 S * 3/2007 Julian ..... D7/409
D555,203 S * 11/2007 Goodman et al. ..... D19/90
7,584,854 B2 * 9/2009 Chandaria ..... 206/736
7,665,612 B2 2/2010 Turner
7,735,649 B2 * 6/2010 Kim-Gifford et al. ..... 206/485
7,743,921 B2 6/2010 Hubbs et al.
7,743,932 B2 * 6/2010 Lynch ..... 211/184
7,815,060 B2 * 10/2010 Iellimo ..... 211/151
7,854,323 B2 * 12/2010 Weissbrod ..... 206/443
7,896,171 B2 * 3/2011 Battaglia ..... 211/59.2
8,192,136 B2 * 6/2012 Walter et al. ..... 414/800
8,307,981 B1 * 11/2012 Weissbrod ..... 206/443
8,413,825 B2 * 4/2013 Spizman et al. ..... 211/184
2002/0000418 A1 * 1/2002 Miller, Jr. ..... 211/188
2003/0034319 A1 * 2/2003 Meherin et al. ..... 211/184
2003/0168368 A1 * 9/2003 Terrell et al. ..... 206/391
2004/0099619 A1 * 5/2004 Bustos ..... 211/59.2
2004/0146373 A1 * 7/2004 Kiester et al. ..... 410/129
2004/0251219 A1 * 12/2004 Zimmerman ..... 211/17
2005/0039640 A1 * 2/2005 Ogden et al. ..... 108/61
2005/0126122 A1 6/2005 Terrell et al.
2006/0016774 A1 * 1/2006 Bustos ..... 211/186
2006/0108307 A1 * 5/2006 Kin ..... 211/189
2007/0163972 A1 * 7/2007 Sopel ..... 211/60.1
2007/0295680 A1 * 12/2007 Budge et al. ..... 211/85.18
2009/0071919 A1 * 3/2009 Blanchet et al. ..... 211/60.1
2009/0145869 A1 * 6/2009 Battaglia ..... 211/153
2011/0062093 A1 * 3/2011 Mcghee ..... 211/50
2011/0162991 A1 * 7/2011 Albrecht et al. ..... 206/443

* cited by examiner

VERTICAL ROLL WRAP PRODUCT TRAY KIT

RELATED APPLICATIONS

This application claims priority to U.S. Provisional Patent Application No. 61/492,091, filed on Jun. 1, 2011, a copy of which is incorporated herein by reference in its entirety.

FIELD OF THE INVENTION

The present invention is in the field of retail displays and more specifically to retail displays for vertical roll wrap product.

BACKGROUND OF THE INVENTION

Sheet material such as paper, plastic films and metal such as aluminum foil and laminates thereof are commonly produced and packaged in rolled form, often rolled about a cylindrical form tube. Sheet material in rolled form provides high density and volume of material and maintains the material in a smooth wrinkle-free condition. The quantity of material in each roll can be selected according to weight, volume, and/or area. Materials which are packaged in this manner are difficult to efficiently display at retail. Due to the large size of the packaged material, these items take up a significant amount of retail space. Commonly, several rolls of rolled gift wrap are displayed within a large cardboard box or other such container. This type of display allows a consumer to see the pattern printed on the gift wrap rolls which are placed at the front or open end of the display, however, consumers must lift up the other rolls which are concealed behind the rolls at the front of the display in order to view the pattern or decorative indicia printed thereon.

Also, from a merchandising perspective, prior fixtures were created specific to certain sized products with permanent dividers at fixed widths. These fixtures could not be easily adapted to changes in product mix.

SUMMARY OF THE INVENTION

A modular vertical roll wrap tray kit of the present invention includes at least one product tray, a plurality of spacer clips, a plurality of wire dividers and a plurality of push clips. The product tray can be attached to various types of retail display units. The product tray contains two ribbed or slotted walls which are sized to accommodate insertion of the wire dividers. The dividers are used to divide the tray into segments or compartments in which the roll wrap material is stored and displayed in a vertical arrangement. The width of the rows or compartments can be varied based on the diameter of the roll wrap product. Spacer clips are used to hold two adjacent dividers into place. The tray is angled slightly in a backwards direction to avoid accidental removal of the vertical roll wrap.

DESCRIPTION OF THE DRAWING FIGURES

DETAILED DESCRIPTION OF PREFERRED AND ALTERNATE EMBODIMENTS

Figure 1:
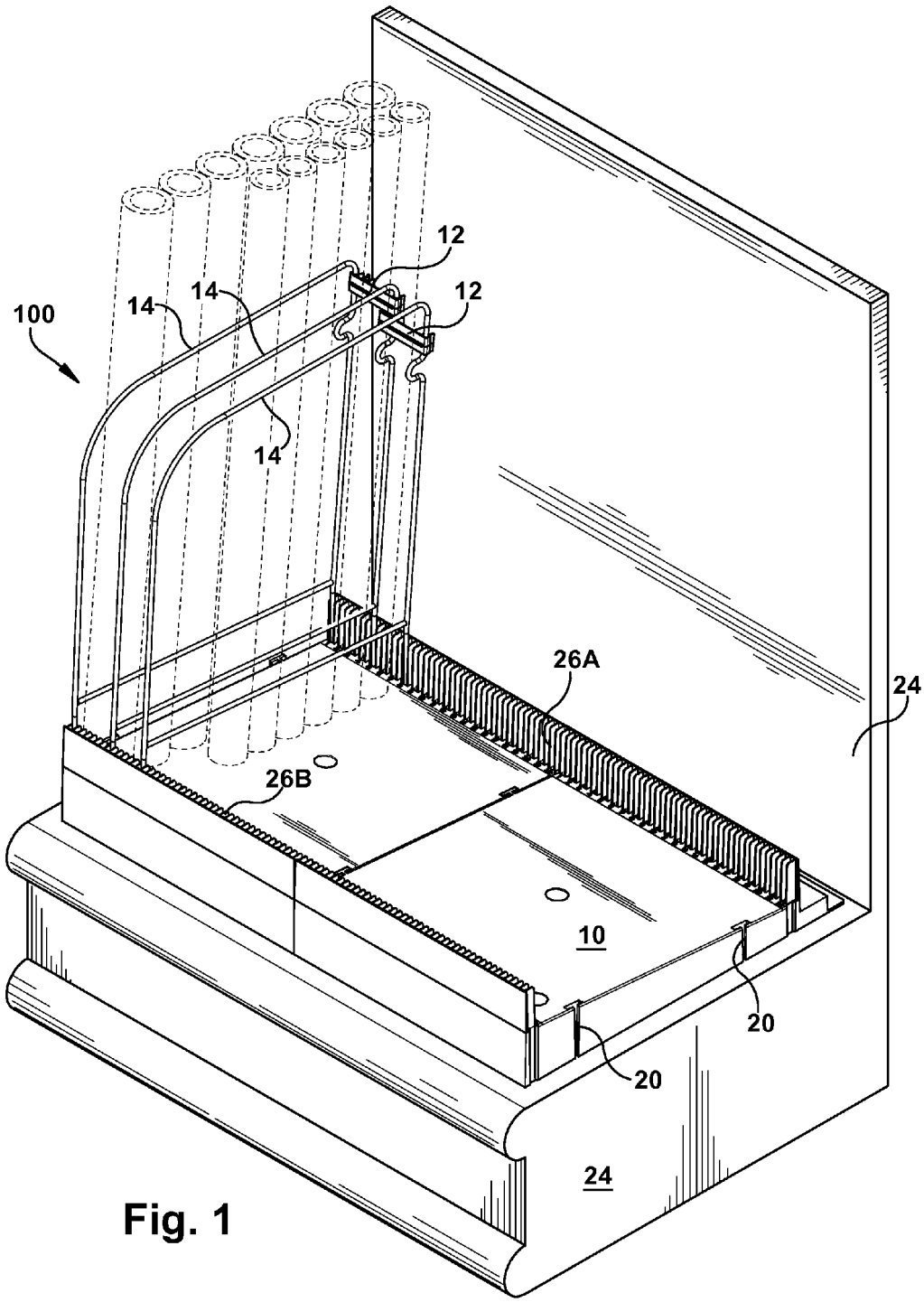
FIG. 1 is a perspective view of the Vertical Roll Wrap Product Tray of the present invention, attached to a retail display.

The modular display kit 100 of the present disclosure and related inventions provides a novel structure for displaying roll wrap sheet material such as gift wrap or other such materials in sheet form in rolled configurations or packages. While directed to gift wrap material, the invention can be used with any sheet material in rolled form, with any amount of cylindrical void or not at the axial center of the rolls and with or without a tube or other cylindrical form or mandrel about which the sheet material is wound. The tube forms may be a paper or cardboard type tube or plastic, or made of any other suitable material or a combination of materials and with any structure which provides an exterior cylindrical form about which sheet material may be wound. The display kit 100 contains and displays the roll wrapped material in a vertical manner in adjacent rows or slots. The display kit includes at least one product tray 10, a plurality of spacer clips 12, a plurality of wire dividers 14 and a plurality of push clips 16.

Figure 4:
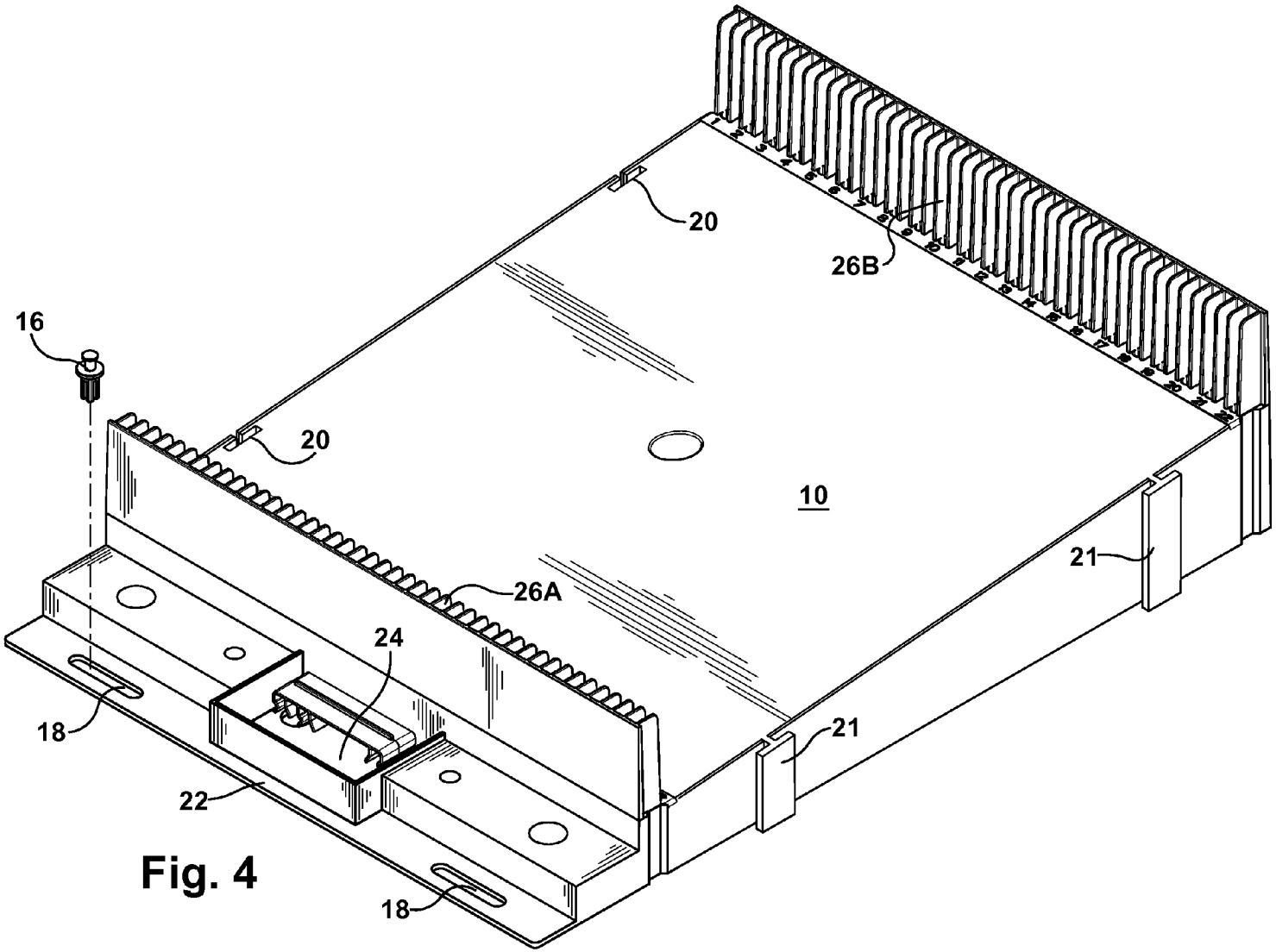
FIG. 4 is a perspective view of the tray of FIGS. 1 and 2.

The product tray 10, as shown in FIG. 4, is preferably made of an injection molded high-impact polystyrene but may alternatively be made of other plastics or other sturdy, lightweight, durable, low cost materials. The tray 10 can be used with a variety of retail fixture bases 24, as shown in FIG. 1, such as a gondola, a bin base or a slimline base. Assembled trays can be attached to display fixtures 24 using a supplemental metal bracket kit or with supplied push-clips 16 which fit into store fixture holes. A single tray 10 can be used to display a variety of roll wrapped material or several trays 10 may be used in combination to display additional roll wrapped material. Each tray 10 is designed to accommodate easy attachment of additional trays via two T-shaped slots 20 on the right side edge of each tray and two T-shaped tabs 21 on the left side edge of each tray. Two or more trays 10 can be combined by inserting the T-shaped slots 20 of one tray into the corresponding T-shaped tabs 21 of another tray. The system is designed to allow for product merchandising in one foot increments and on various display fixture types. Each tray 10 is substantially square or rectangular-shaped having a top side edge, a bottom side edge opposite the top side edge, a right side edge extending between the top and bottom side edge and a left side edge opposite the right side edge and extending between the top and bottom side edge. A flange 22 is attached to the top side edge having various holes or openings for attachment to a retail base fixture and a compartment 24 for storage of extra spacer clips, push clips or other small parts. Push clips 16 can be used to attach the product tray 10 to a retail fixture through the various holes or openings in the flange 22 section of the tray 10. In a preferred embodiment, the product tray 10 is approximately 16.25 inches long (between top edge and bottom edge) and 11.75 inches wide (between right and left side edges). The surface of the tray is angled backwards (towards the back of the display) at an approximate 5-degree angle. The lower elevation at the top side edge (back of the display) helps to retain the roll wrapped products within the tray 10. A ribbed or slotted wall 26A, 26B is located at both the top and bottom side walls (at the back and front of the display). The slotted walls 26A, 26B contain approximately 44 equal sized slots, although any number of slots may be used. Every other slot contains an insertion hole or aperture to accommodate the wire dividers 14 with a friction fit to prevent easy removal. The slots or ribs provide additional support to prevent excess movement of the dividers 14 in a lateral direction. The system allows flexibility of divisions in approximately ½-inch increments and widths ranging from 1-foot to several feet and can be re-configured to add or subtract dividers and/or additional trays.

Figures 2, 3:
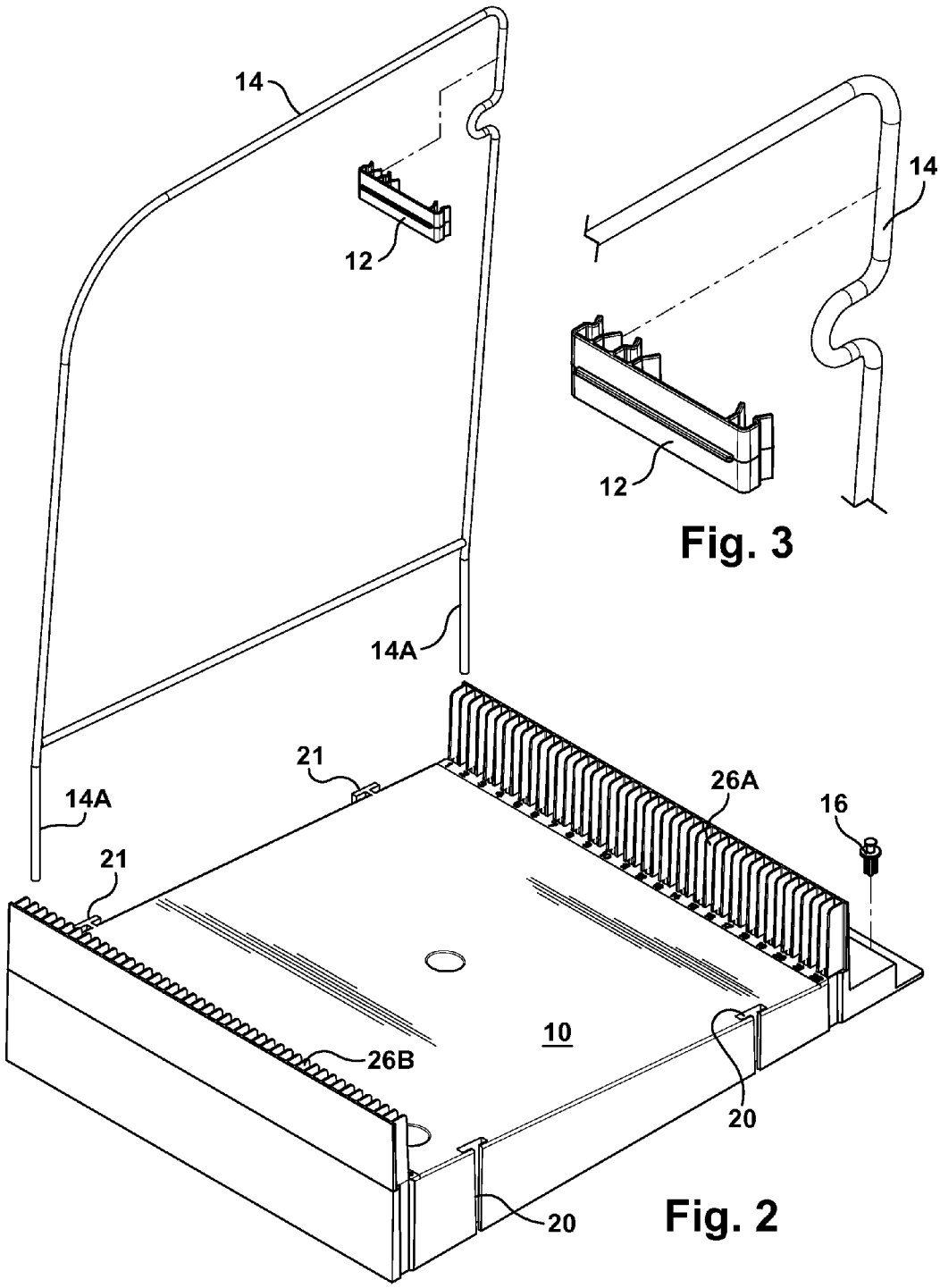
FIG. 2 is an exploded view of the Vertical Roll Wrap Product Tray of FIG. 1.
FIG. 3 is a close-up view of the wire divider and spacer clip of FIG. 2.

Wire dividers 14, shown in FIGS. 1 and 2, are inserted into the product tray 10 by pressing them firmly into the holes or apertures in the product tray 10, thereby creating separate adjacent rows or compartments between each adjacent pair of dividers into which roll wrap material can be organized and displayed. A single row or compartment is created between each adjacent pair of dividers 14. For example, three wire dividers placed adjacent to one another in the tray 10 would create two adjacent rows or compartments within which roll wrap product may be inserted. In most cases, the product will be arranged in a single line or row. Multiple roll wrap products of the same design may be placed within the same row or compartment so that the first roll wrap product in each row displays the product design for each product in the same row. Also, double and triple roll combination packs (two or three rolls of roll wrap product side-by-side and contained within the same packaging) may also be held in the tray 10. In the case where double or triple roll wrap products are displayed in the tray 10, the spacer clips 12 cannot be used due to the width of the space between the adjacent dividers 14 to hold the multiple roll packages. The ease in which the dividers 14 can be inserted and removed from the tray 10 allows for the display and storage of various sized rows of roll wrap product and allows for several different sized rolls or various combinations of roll wrap packages to be displayed on the same or adjacent trays 10. Each wire divider 14 is a four-sided figure with two attachment posts 14A extending from opposite sides of the bottom of the figure for attachment with the product tray 10. The diameter of the wire is designed to snugly fit into the insertion holes located between the slots in the slot wall 26A, 26B located on the product tray 10. The slots are numbered consecutively so that the bottom of the back wire and the bottom of the front wire are inserted into the same slot on the opposing slot walls 26A, 26B. One of the sides of the four-sided figure has a length that is longer than that of the other opposite side such that the dividers are angled, as shown in the figures. Placing two dividers 14 into the product tray 10 at a spaced apart arrangement creates an adjustable row or section within which vertical roll wrap product can be contained and displayed. The width of each row or compartment can be made as thin or as wide as the diameter of the roll wrap product requires. Roll wrap having a larger diameter can be positioned directly next to roll wrap having a smaller diameter. Also, the dividers 14 can be removed and re-configured to accommodate a change in product mix. In a preferred embodiment, the attachment posts 14A are approximately 3 inches long, a portion of which is inserted into the product tray 10. The entire divider is approximately 16.09 inches long and 13.24 inches wide. The steel wires may be powder coated.

Several spacer clips 12 are used to removably attach each wire divider 14 to an adjacent wire divider 14 and provide positive fixed spacing and further stabilization of the dividers. A spacer clip 12, as shown in FIG. 3 is a small attachment mechanism having a planar back surface and a front surface having three or more insertion slots to accommodate portions of the wire divider 14. The three slots can be used to adjust the width of the row or section, as described above. The width of each insertion slot is slightly smaller than the diameter of the wire divider 14 at the slot entrance so that the divider 14 can be snapped into the slots without easily slipping out. The spacer clip 12 is preferably made of molded plastic or other durable material that can easily be bent or bowed for insertion and removal of the dividers within the spacer clips 12. One spacer clip 12 can be used to attach two adjacent dividers 14. One divider 14 may have two spacer clips 12, one spacer clip 12 attaching the divider 14 to each adjacent divider 14. The spacer clips 12 are added to the rear, top of the dividers. In a preferred embodiment, the spacer clip 12 is approximately 2.43 inches wide and approximately 0.420 inches long. The spacer clips 12 also provide a fixed support for the innermost roll wrap product contained within the tray 10. The innermost roll wrap product may rest against the spacer clip 12 when stocking, establishing a consistent approximate 5 degree lay-back angle. This is important to maintain uniformity of roll wrap product presentation in that the variety of base fixtures to which the tray can be attached, do not provide a consistent rear stop position to orient the product.

While certain shapes and dimensions of the vertical roll wrap product tray of the present invention have been described herein and shown in the figures, these shapes and specific dimensions are intended to describe one embodiment of the invention and are not meant to limit the invention to these shapes and dimensions. Other shapes and sizes of the various components of the invention described herein have been contemplated and are considered to be within the scope of the present invention. Also, certain materials have been described herein with reference to the base and dividers, however these descriptions are meant to describe a preferred embodiment and other materials can be used and are also considered to be within the scope of the present invention.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive. Other features and aspects of this invention will be appreciated by those skilled in the art upon reading and comprehending this disclosure. Such features, aspects, and expected variations and modifications of the reported results and examples are clearly within the scope of the invention where the invention is limited solely by the scope of the following claims.

What is claimed is:

1. A vertical roll wrap tray comprising:

at least one tray having a top surface, a bottom surface, a first slotted wall located at the back of the at least one tray opposite a second slotted wall located at the front of the tray, both the first and second slotted walls having a plurality of adjacent slots, the first and second slotted walls both extend upwardly from the top surface of the at least one tray; wherein the top surface of the least one tray slopes downwardly from the second slotted wall towards the first slotted wall; a plurality of apertures formed in the top surface of the tray;

two or more wire dividers, each wire divider having a first attachment post opposite a second attachment post and each wire divider having a vertical height of at least 16 inches;

one or more attachment clips removably attached to the two or more wire dividers;

wherein the first attachment posts of the two or more wire dividers are each inserted into a corresponding aperture located within a respective slot of the first slotted wall and the second attachment posts of the two or more wire dividers are each inserted into a corresponding aperture located within a respective slot of the second slotted wall and directly across from the corresponding apertures into which the first attachment posts are inserted.

2. The vertical roll wrap tray of claim 1, wherein the one or more attachment clips each have two or more slots.

3. The vertical roll wrap tray of claim 2, wherein two of the wire dividers are inserted into two corresponding slots on one of the attachment clips.

4. The vertical roll wrap tray of claim 1, wherein the at least one roll wrap tray is attached to a retail display fixture via one or more push clips.

5. The vertical roll wrap tray of claim 1, wherein the at least one tray contains two t-shaped slots located on one side of the at least one tray and two t-shaped tabs located on an opposite side of the at least one tray.

6. The vertical roll wrap tray of claim 5, wherein two trays are connected by inserting the two t-shaped tabs from a first tray into the two t-shaped slots of a second tray.

7. The vertical roll wrap tray of claim 1, further comprising a flange on one side of the at least one tray having a plurality of openings thereon for attachment to a retail display fixture.

8. A vertical roll wrap tray comprising:

a substantially rectangular tray having a top surface, a bottom surface, a first side located at a rear of the tray opposite a second side located at a front of the tray and a third side opposite a fourth side, the first and second sides each having a slotted wall extending upward therefrom, wherein the top surface of the tray slopes downwardly from the front of the tray towards the rear of the tray; the bottom surface of the tray is configured to be mounted to a display fixture having a base and a back wall; wherein top surface of the tray is inclined rearwardly towards the back wall of the display fixture, when the tray is attached to the display fixture;

the slotted walls each have a plurality of vertical slots contained thereon, each vertical slot has an opening;

a plurality of divider wires, each divider wire having a first end which is configured to frictionally fit within corresponding openings of the corresponding vertical slots on the slotted wall located on the first side of the tray and a second end which is configured to frictionally fit within the corresponding openings of the corresponding vertical slots on the slotted wall located on the second side of the tray;

wherein each adjacent pair of the plurality of divider wires inserted into the slotted walls of the tray creates a linear row into which one or more roll wrap products may be inserted.

9. The vertical roll wrap tray of claim 8, wherein a said tray is a first tray and said first tray is attached to a second tray by inserting at least one t-shaped tab contained on the first tray into at least one t-shaped slot contained on the second tray.

10. The vertical roll wrap tray of claim 8, further comprising one or more spacer clips, each spacer clip having one or more slots for insertion of one or more of the plurality of divider wires.

11. The vertical roll wrap tray of claim 10, wherein the one or more spacer clips are removably attached to the one or more divider wires; each spacer clip having a first end and a second end; wherein the first end of one spacer clip is attached to a first divider wire and the second end to the one spacer clip is attached to a second divider wire which is located adjacent to the first divider wire.

12. The vertical roll wrap tray of claim 8, further comprising a flange which is attached along the first or second side of the tray, the flange containing one or more openings thereon.

13. The vertical roll wrap tray of claim 12, wherein the tray is attached to the retail display fixture by inserting one or more push clips through the corresponding one or more openings on the flange and into the retail display fixture.

14. The vertical roll wrap tray of claim 8, wherein each of the plurality of slots on the slotted walls are numbered to ensure that the plurality of divider wires are inserted into matching slots of the opposed slotted walls.

15. A vertical roll wrap tray comprising:

a substantially rectangular base having a top surface, a bottom surface, and a front edge which is at a higher elevation than an opposed rear edge;

wherein the top surface of the base is sloped backwards towards the rear edge of the base;

the base having a first slotted wall located at the rear edge of the tray and a second slotted wall opposite the first slotted wall located on the front edge of the base;

the first and second slotted walls each having a plurality of uniform-sized slots contained thereon, every other slot having an aperture formed in the top surface of the base within said every other slots;

a plurality of wire dividers each having one rear side which has a length which is longer than that of an opposite front side of said corresponding wire dividers and a top that connects said opposed front and rear sides together such that each of the tops of the plurality of wire dividers slopes downwardly from the rear side to the front side; wherein the bottom surface of the base is configured to be mounted to a display fixture having a back wall;

the front and rear sides of each wire divider are configured to snugly fit into corresponding apertures within every other slot of the first and second slotted walls;

wherein two adjacent wire dividers are inserted into corresponding apertures within corresponding slots of the first and second slotted walls to form a compartment into which a plurality of roll gift wrap products may be contained.

16. The vertical roll wrap tray of claim 15, wherein when in use, the plurality of roll wrap products contained between two adjacent wire dividers are arranged in a single vertical row.

17. The vertical roll wrap tray of claim 15 further comprising a plurality of spacer clips which are removably attached to each pair of adjacent wire dividers.

18. The vertical roll wrap of claim 15, wherein the base is configured to be attached to other vertical roll wrap tray base.

19. The vertical roll wrap tray of claim 15, wherein pairs of adjacent wire dividers may be inserted into corresponding apertures within respective slots of the first and second slotted walls at non-uniform distances, creating non-uniformly sized compartments.

* * * * *